United States Patent [19]

Saito

[11] 4,226,035

[45] Oct. 7, 1980

[54] APPARATUS FOR CONTINUOUSLY DREDGING SUBMARINE MINERAL DEPOSIT

[76] Inventor: Nakaji Saito, 6-3, Higashi Jujyo, Kitaku, Tokyo, Japan

[21] Appl. No.: 871,197

[22] Filed: Jan. 21, 1978

[30] Foreign Application Priority Data

Oct. 25, 1977 [JP] Japan ..... 52/127755

[51] Int. Cl.[3] ..... E02F 3/08; E02F 3/14

[52] U.S. Cl. ..... 37/69; 37/DIG. 8; 24/115 R; 24/265 EE; 198/711; 403/268; 403/305

[58] Field of Search ..... 37/69, DIG. 8; 198/711, 198/712, 700; 403/268, 305

[56] References Cited

U.S. PATENT DOCUMENTS

| | | | |
|---|---|---|---|
| 1,159,237 | 11/1915 | Larson | 198/712 |
| 2,652,231 | 9/1953 | Smith | 403/268 X |
| 2,868,863 | 1/1959 | Cook | 403/305 X |
| 3,282,445 | 11/1966 | Wallace, Jr. | 198/700 X |
| 3,672,079 | 6/1972 | Masuda et al. | 37/69 |
| 3,943,644 | 3/1976 | Walz | 37/69 |

FOREIGN PATENT DOCUMENTS

| | | | |
|---|---|---|---|
| 694589 | 9/1964 | Canada | 37/69 |
| 296975 | 12/1915 | Fed. Rep. of Germany | 198/712 |

*Primary Examiner*—Clifford D. Crowder
*Attorney, Agent, or Firm*—Kane, Dalsimer, Kane, Sullivan & Kurucz

[57] ABSTRACT

An apparatus for continuously dredging submarine mineral deposit comprising plural pairs of pulleys, each of which is pivoted coaxially at a preset distance. Plural pairs of specific endless ropes are adapted to be brought into contact with said pulleys and to be driven in translation movement with each other. Means is provided for preventing slippage between said ropes. When buckets for scraping up ores are being circulated between the upper deck of a barge and the seabed, said endless ropes are directed to travel downward from the upper part in a diagonally rearward direction. Also provided is an ore discharging chute adjacent to a spot where each of said buckets begins to glide down.

2 Claims, 13 Drawing Figures

Fig. 4
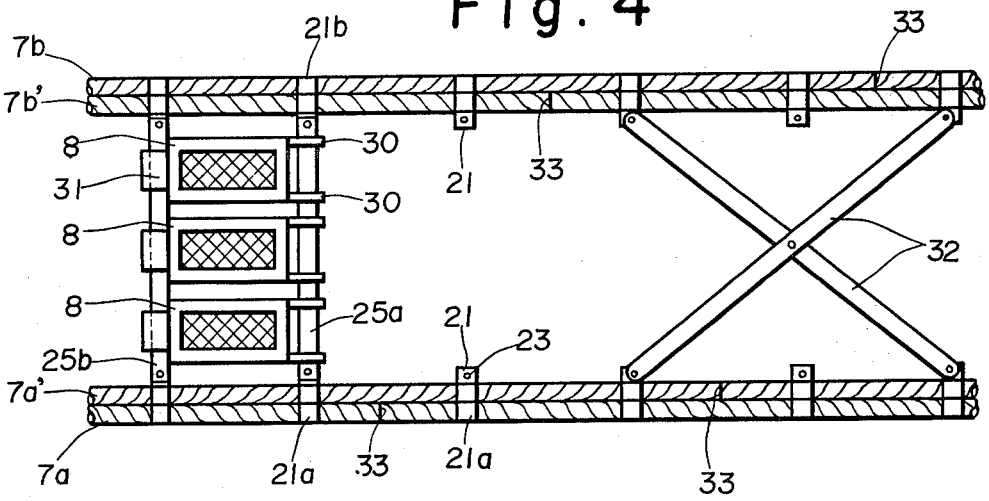
Fig. 5
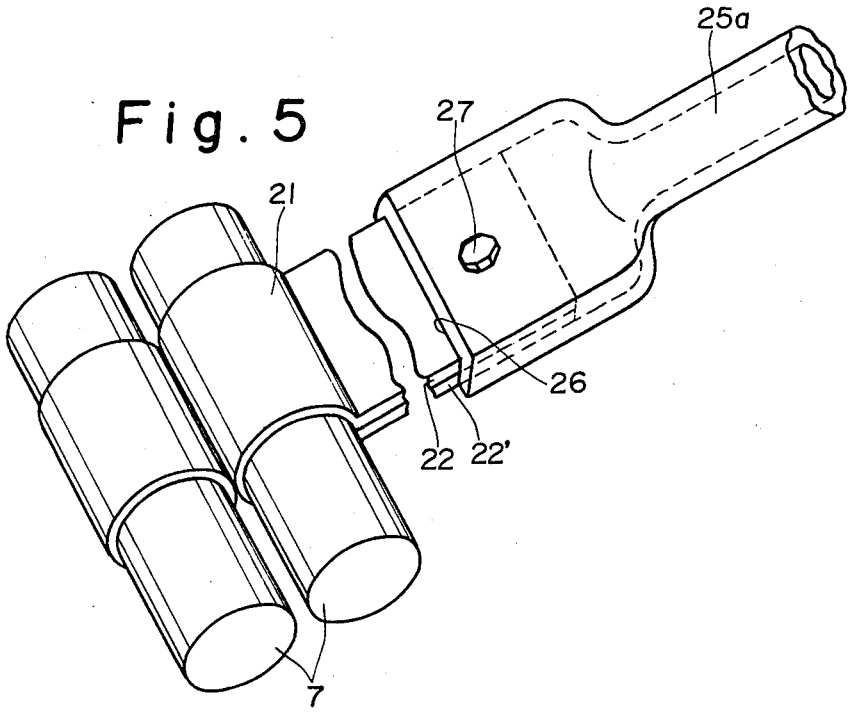
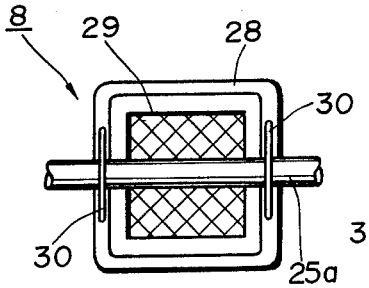
Fig. 6(A)
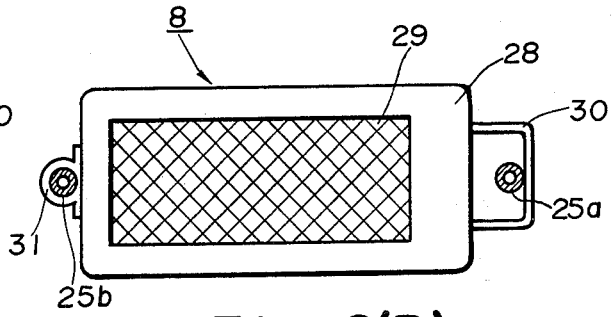
Fig. 6(B)

APPARATUS FOR CONTINUOUSLY DREDGING SUBMARINE MINERAL DEPOSIT

BRIEF SUMMARY AND BACKGROUND OF THE INVENTION

The present invention relates to an apparatus for dredging up mineral resources, for instance, agglomerate manganese and the like scattered over the seabed.

In this kind of apparatus it is conventional to provide an endless rope fitted with a number of buckets at an equidistance to be conveyed downward to the seabed from a working barge floating on the sea level. The endless rope is pulled up by means of pulleys mounted on the barge to obtain ores gathered up in said buckets, then said buckets are once more glided down to the seabed for circulating said endless rope between the upper deck of the barge and the seabed so as to perform continuous gathering of submarine ores. In the foregoing apparatus, each of said pulleys is provided at the outer periphery thereof with grooved portions for engagement with said bucket, and the position for fitting said bucket on the endless rope has generally been adjusted to engage the bucket within the grooved portion satisfactorily. However, sometimes the endless rope becomes swollen and somewhat elongated in the seawater. In some cases, the endless rope may cause slipping on the pulley, so that even though it has previously been adjusted so that the bucket should be engaged within the grooved portion of the pulley. As the operation time elapses, the bucket does not engaged successfully within the grooved portion of the pulley, thereby troubles such as fracture of buckets and the like have frequently taken place.

The present invention is aimed at to solve the abovementioned problems occurring in conventional apparatus as well as to provide an apparatus which absolutely dispenses with the foregoing adjustment of positions for fixing brackets on the endless rope and is able operate safely and reliably at all times in spite of later troubles such as swelling of ropes by the sea water or slipping of ropes on the pulleys.

BRIEF DESCRIPTION OF THE DRAWINGS

The present invention will now be explained with reference to the drawings by way of example in a form of embodiment of the invention, in which:

FIG. 4 is a plan view showing endless ropes 7 and buckets 8 and other fittings;

FIG. 5 is a partially perspective view showing clamping means 21 and a rod 25*a;*

FIG. 6(A) is an elevational view showing the state of the rod 25*a* connected with a bucket 8;

FIG. 6(B) is a side view of the above same;

FIG. 9 to FIG. 11 show a modified embodiment of the present invention respectively, in which;

FIG. 9 is a plan view showing an endless rope 7, buckets 8 and other constitutional parts;

FIG. 10 is a plan view showing pulleys 2 and guide rollers 16; and

FIG. 11 is a partially sectional view of a clamping means 21 showing how to release endless ropes 7*a, 7action in a chain line.*

DETAILED DESCRIPTION OF THE INVENTION

Figure 1:
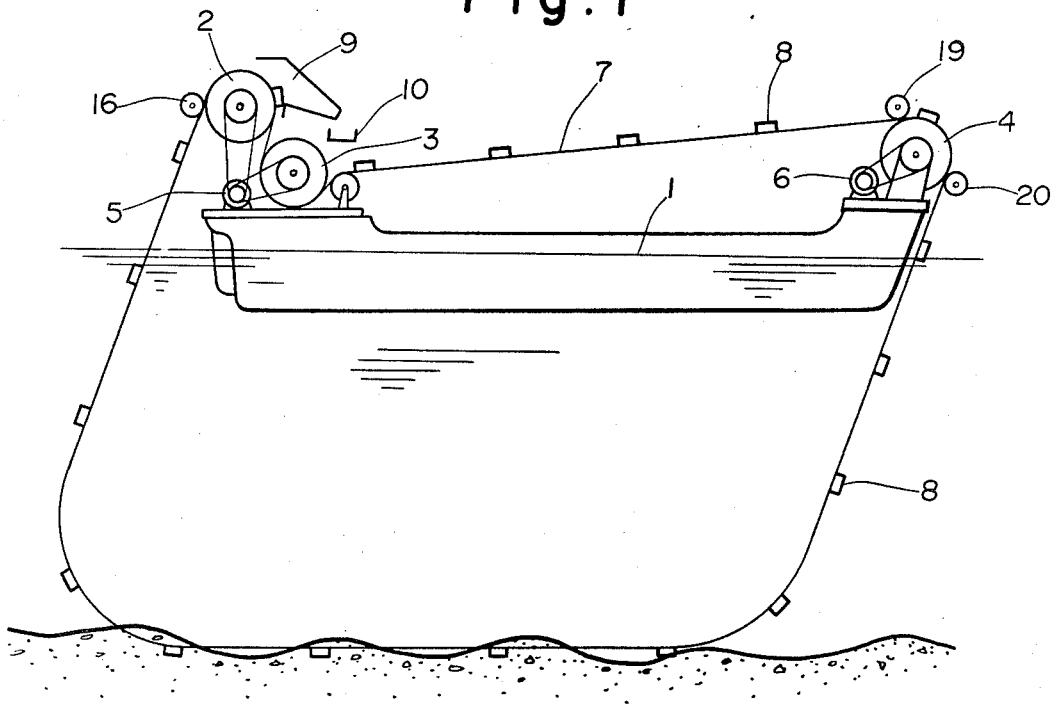
FIG. 1 is a schematic drawing of an apparatus according to the present invention.
Figure 2:
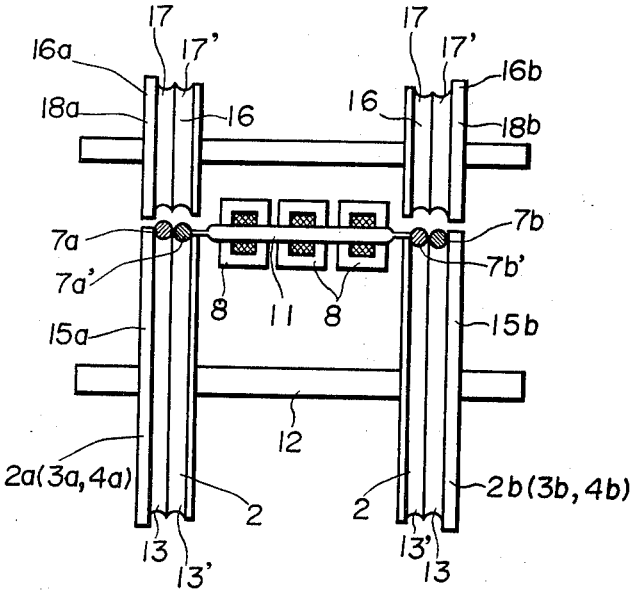
FIG. 2 is a plan view of pulleys 2 and guide rollers 16 showing the positional relation in their arrangement.
Figure 3:
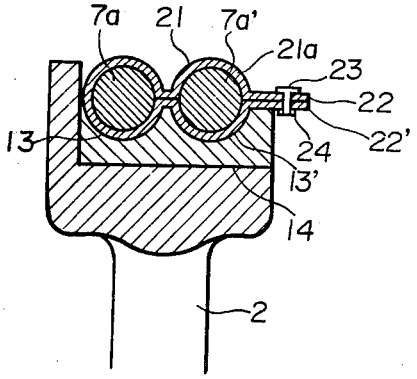
FIG. 3 is a partially sectional view of a pulley 2.

As shown in the schematic drawing, FIG. 1, the reference numeral 1 designates a working barge floating on the sea. The working barge 1 is equipped on the upper deck thereof with pulleys 2, 3 and 4 as well as driving machines 5 and 6 for actuating the pulleys, and pulleys 2, 3 and 4 are adapted to drive an endless rope 7 to run above the upper deck of the barge and over the surface of the seabed. The endless rope 7 is furnished with equidistintally arranged buckets 8, 8—for scraping up ores from the seabed. The buckets 8, 8 filled with ores dredged up from the seabed are adapted to discharge ores on the working barge 1. In order to facilitate the discharge of ores from said buckets 8, 8 on the working barge 1, the pulley 3 is arranged to be disposed below the pulley 2 and partially overlapping one another when viewed from above. An ore discharging chute 9 for receiving ores which are discharged from the buckets is located near the spot where the bucket 8 passed around the pulley 2 starts to glide downward. A chute 10 for transferring ores down to an ore storage (not shown) equipped in the barge is located at the outlet of ore discharging chute 9. The endless rope 7 is composed of two pairs of endless ropes as shown in FIG. 2, one pair of endless ropes are gathered together with two endless ropes 7*a* and 7*a'*, while the other pair of endless ropes involve two endless ropes 7*b* and 7*b'* assembled together. Rods 11, 11 are bridged between two pairs of the endless ropes, furthermore, a bucket 8 is fixed between two of said rods 11, 11. Moreover, the pulley 2 is composed of two component pulleys 2*a*, 2*b* respectively pivoted to an axis 12 and the distance between the two component pulleys 2*a* and 2*b* is set nearly equivalent to the distance between the foregoing two pairs of endless ropes. A rubber sheet 14 is adhered tightly onto each of the outer peripheries (where the endless rope is in contact therewith) of said pulleys 2*a* and 2*b*. The rubber sheet 14 is formed respectively with longitudinal grooves 13 and 13' as shown in FIG. 3, in addition, on the outermost side faces of the pulley 2 are formed each of flanges 15*a* and 15*b* respectively. Endless ropes 7*a*, 7*a'* and 7*b*, 7*b'* are respectively driven by pulleys 2*a* and 2*b* passing over to come into contact with said longitudinal grooves 13, 13' and 13, 13'. However, to ensure that the movement of the foregoing endless ropes passing thereover brings them into contact with the grooves, guide rollers 16 including 16*a* and 16*b* are arranged to be dispoed adjacent to the spot where endless ropes 7*a*, 7*a'* and 7*b*, 7*b'* begin to come into contact with pulleys 2*a*, 2*b*. Onto the outer peripheral surfaces of guide rollers 16*a* and 16*b* are stuck securely a rubber sheet forming lengthwise grooves 17 and 17' respectively as well as at the outermost side faces of the guide rollers are formed respectively flanges 18*a* and 18*b*. In this manner, as shown in FIG. 2, the postures of guide rollers 16*a* and 16*b* at the outer peripheral surfaces thereof are formed nearly identical with that of pulleys 2*a* and 2*b* at the outer peripheral surfaces thereof located near the guide rollers respectively. Furthermore, pulleys 3 and 4 are composed of two coaxially pivoted component pulleys 3*a*, 3*b* and other two coaxially pivoted component pulleys 4*a*, 4*b* in the same manner as the assembly of pulley 2, and on the outer peripheral surfaces of pulleys 3*a*, 3*b* and 4*a*, 4*b* respectively are securely stuck another rubber sheet forming thereon longitudinal grooves, while at the outermost side faces of pulleys 3 and 4 are formed upright flanges respectively. Still further, guide rollers 19 and 20 are arranged to be disposed adjacent to the spots where endless ropes 7 begin to come into contact with and terminate the contact with pulley 4 in the same manner as shown in FIG. 2. The endless ropes 7*a*, 7*a*' and 7*b*, 7*b*' are gripped together to form each pair at a relatively short distance between the gripped positions with the aid of clamping means 21, 21 as shown in FIG. 3 and FIG. 4. The clamping means 21 is made of metal strip sheet which is folded in double to encompass two endless ropes 7*a*, 7*a*' or 7*b*, 7*b*', and both end portions 22, 22' of the metal strip sheet are securely fixed by bolts 23 and nuts 24 to be caulked for filling up gaps between the endless rope and the metal strip sheet. The clamping means 21*a* and 21*b* are fixed to the endless rope in such an arrangement that the straight line extending between the clamping means 21*a* for fastening one pair of endless ropes 7*a*, 7*a*' together and the clamping means 21*b* for fastening the other pair of endless ropes 7*a*, 7*b* together nearly orthogonally crosses the endless rope 7.

The bucket 8 is fixed to the endless rope 7 making use of clamping means 21*a* and 21*b*. In other words, as shown in FIG. 4 and FIG. 5, a rod 25*a* made of a metal pipe having both ends crushed flat to form substantially a rectangular surface respectively is interposed between clamping means 21*a* and 21*b* arranged to be facing each other, and another rod 25*b* is arranged adjacent to said rod 25*a* just the same way as set forth above. Moreover, the bucket 8 is fitted between said two rods 25*a* and 25*b*. The rod 25*a* or 25*b* and the clamping means 21 are joined together as illustrated in FIG. 5 in a manner that clamping means 21 is inserted at both end portions 22 and 22' thereof into the opening 26 formed on the end surface of the rod 25*a* and securely fastened by bolts 27 and nuts (not shown). As shown in FIGS. 6(A) and (B) respectively, the bucket 8 is composed of a boxshape frame work 28, net-like bodies 29 securely fixed to the side face and the bottom face of said frame work 28, two handles 30, 30 protruding forward in the traveling direction of the bucket from said frame work 28 disposed at the end surface of the opening formed on the bucket, and a cylindrical body 31 fixed to said frame work 28 at the outer bottom surface thereof. Rod 25*b* is inserted through cylindrical body 31 to fix the bucket 8 rotatably to rod 25*b*. In the same manner the rod 25*a* is inserted within handle 30 so as to permit bucket 8 to be rotatable to some extent about said rod 25*a*.

In order to prevent slippage in the lengthwise direction of the rope fitted with the rods 25*a* and 25*b* diagonally to the endless rope which may be caused due to the positional interrelation between the pair of endless ropes 7*a*, 7*a*' and the pair of endless ropes 7*b*, 7*b*', two rods 32, 32 mutually crossing each other are interposed at an appropriate position between the pair of endless ropes 7, 7*a*' and the other pair of endless ropes 7*b*, 7*b*' as shown in FIG. 4. The foregoing two rods 32,32 are respectively connected with the endless rope through the clamping means 21 and are joined together at the crossing juncture by means of bolt and nut.

Figure 7A:
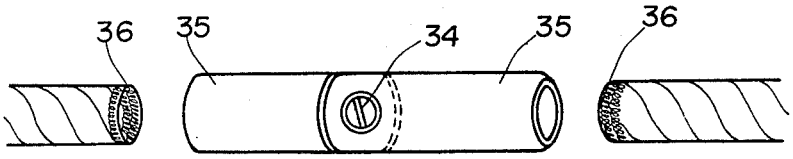
FIG. 7(A) is a perspective view showing both end portions 36, 36 of the rope and collars 35, 35.
Figure 7B:
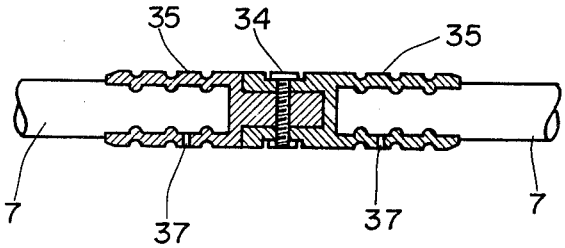
FIG. 7(B) is a longitudinal sectional view showing the state of the rope 7 being securely adhered to said collars 35, 35 by inserting both end portions 36, 36 of said rope into the respective collars 35, 35.

When one endless rope is made of one rope, one junction 33 of the rope is necessarily formed, and this junction 33 of the rope is formed in the manner illustrated in FIGS. 7(A) and (B). The end portions 36, 36 of the rope are respectively inserted into two collars 35, 35 rotatably encompassing bolt 34, and collars 35, 35 are caulked at the outer peripheral surface thereof. Then 2 liquid adhesives of a reaction hardenability type is injected from throughholes 37, 37 provided on said collars 35, 35 respectively to adhere securely the end portions 36, 36 of the rope to collars 35, 35. In order to facilitate manipulation for inserting the end portions 36, 36 of the rope into said collars 35, 35, the end surface of the rope is subjected to fusion welding. For the sake of preventing weakening of the endless rope 7, the junction 33 of the rope is formed at a different spot on each pair of the rope so as to avoid alignment of said junctions at one and the same spot as illustrated in FIG. 4.

The endless ropes 7*a*, 7*a*' are assembled together in an array in an inversely twisting direction of each rope. Also, the endless ropes 7*b*, 7*b*' are assembled together in the same way as mentioned above so as to avoid difficulty caused by the endless rope 7 being twisted up by itself.

Further, if one endless rope is not made by a single rope but made with a plurality of ropes joined to one another, the junction 33 of the rope can be formed at a plurality of spots. Moreover, junctions 33 formed on two endless ropes are located at positions so that the abutting state at said junction of other endless rope can be maintained securely as is even when one junction 33 of any endless rope is disconnected, thereby avoiding accidental falling of the rope or buckets into the sea.

Figure 9:
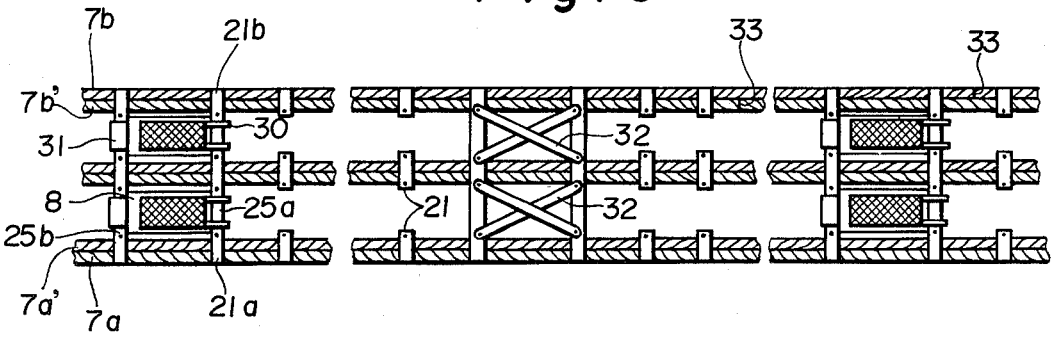
Figure 10:
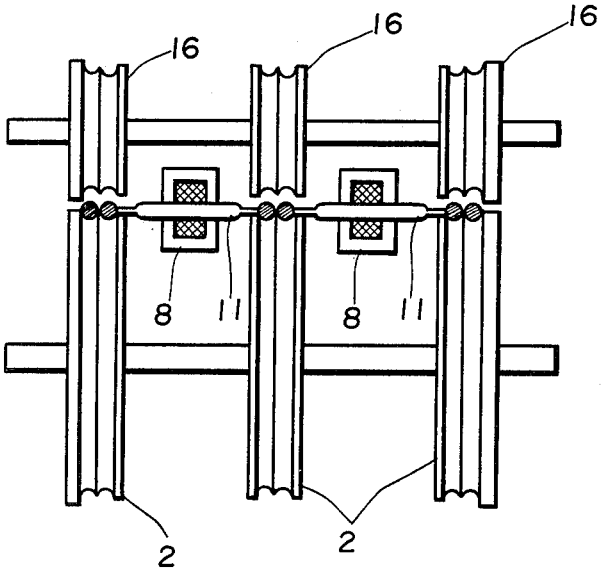
Figure 11:
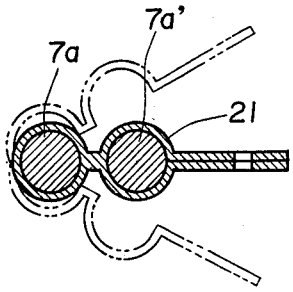

FIG. 9 to FIG. 11 show a modified embodiment of the present invention. In the foregoing example, the endless rope 7 is composed of two pairs of endless ropes, while in this modification, the rope is composed of three pairs of endless ropes and the rest of the construction is the same as in the foregoing example.

Following is an explanation of the function of the foregoing example, in which the driving machines 5 and 6 respectively actuate and rotate the pulleys 2, 3 and 4 to cause the endless rope 7 to travel about pulleys. The endless rope 7 is tightly assembled together to be paired with two ropes by virtue of the clamping means 21. Both end portions 36, 36 of the rope are securely abutted to each other by means of collars 35, 35. Also, the junctions 33 of the rope are arranged to be formed at different spots so as to be able to avoid alignment of the positions thereof on each pair of ropes. Thus, the strength of the endless rope 7 can be maintained at a remarkably high degree. Moreover, two endless ropes of each pair are assembled into an array in the direction inversely twisting to each other as well as two rods 32, 32 arranged to cross each other are fitted between two pairs of endless ropes, so that the endless rope 7 is discouraged from easily twisting upon itself and also is prevented from slipping in the lengthwise direction between the endless ropes 7*a*, 7*a*' and 7*b*, 7*b*'.

The bucket 8 is fitted between two pairs of endless ropes (7*a*, 7*a*') and (7*b*, 7*b*') through the rod 25, while each of pulleys 2, 3 and 4 for respectively driving the foregoing endless ropes 7*a*, 7*a*' and 7*b*, 7*b*' is composed of two coaxially pivoted component pulleys, and the bucket 8 is adapted to travel between said two coaxial component pulleys. Therefore, it is unnecessary to adjust the position of the bucket in the lengthwise direction of the rope. The rubber sheet 14 provided with longitudinal grooves 13, 13' has been adhered tightly to the pulleys on the outer peripheral surface thereof (where the endless rope comes into contact with said surface). Both the pulley 2 for initially driving the endless rope which has been pulled up from the seabed and the pulley 4 for sending the endless rope downward into the sea from the working barge are respectively provided with a guide roller 16 at the position where the former pulley begins to come into contact with the endless rope and/or where the latter pulley terminates the contact with the endless rope. Each of guide rollers 16*a*, 16*b* has nearly the same profile at the outer peripheral surface thereof to each of the corresponding pulleys. Therefore, the endless ropes are driven into reliable engagement with said pulleys accordingly.

Furthermore, when the endless rope is advanced to the pulley 3 from the pulley 2, the endless rope is adapted to be advanced downward in a diagonal direction from the pulley 2 disposed above the pulley 3, ores filled in the bucket is completely discharged from the bucket, and since the discharge chute 9 is disposed adjacent to the spot where the bucket 8 starts to be glided downward and the transfer chute 10 is located near the outlet of discharge chute 9, the discharged ores can be transferred skillfully to the place desired.

Furthermore, since the bucket 8 is installed to be somewhat movable in the vertical direction at the opening thereof between two rods, said opening can be adjusted properly to the undulation of the seabed.

However, the number of endless ropes set in each pair is not limited to two ropes as set forth hereinbefore, but an optional number of ropes can be used instead. In case of employing nylon endless ropes, six ropes assembled in each pair is desirable as indicated in the nomographic example defined as the result of various experiments by the present inventors.

While each of pulleys 2, 3 and 4 is composed of two component pulleys respectively in the foregoing embodiment, in some cases, more than two component pulleys may be used for each of said pulleys.

An explanation will now be given hereinafter in a concrete way on the utility for a plurality of ropes to be realizable through the nomographic example employing nylon endless ropes.

Figure 8:
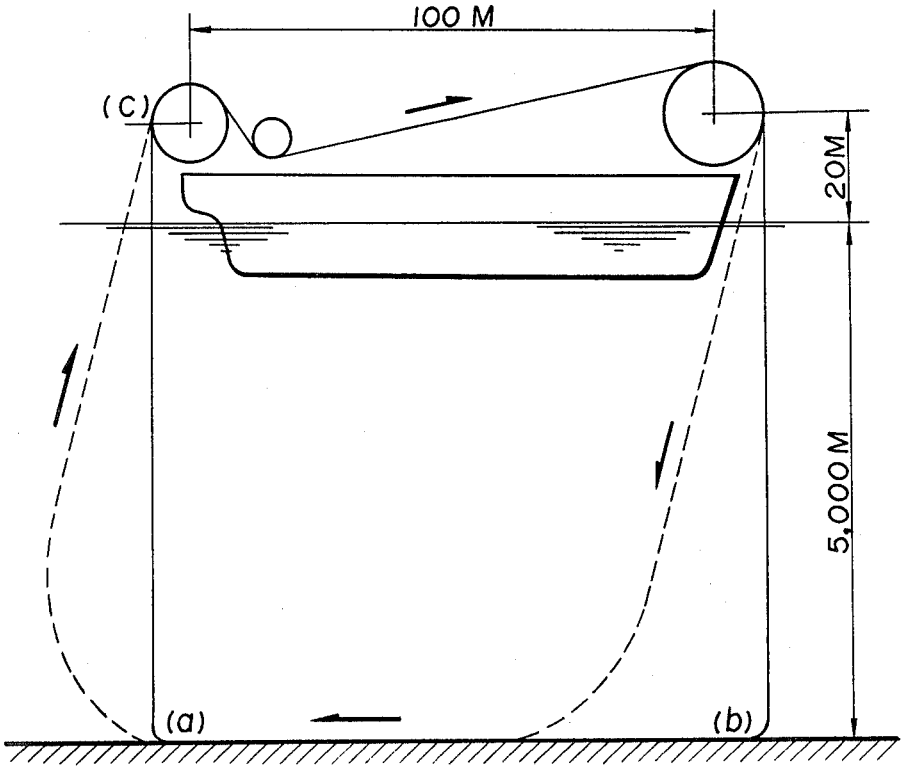
FIG. 8 is a reference diagram of a nomographic example.

DETAIL (refer to FIG. 8)

| | | |
|---|---|---|
| | Depth of sea water | 5,000 m |
| | Distance between "drums" | 100 m |
| | Position of a "drum" above the sea-level | 20 m |
| | Process of landing (pulling up) ropes: | |
| | A type of buckets in two rows | |
| | Dimensions of a "bucket" 100 cm × 70 cm × 35 cm | |
| | Ropes used for landing operation | |
| | $65^{\phi mm}$ nylon eight ropes | 6 |
| | Distance between "buckets": | 20 m |
| | Landing velocity of "buckets": | 25m/min. |
| (1) | Tensile strength of one nylon eight rope of $65^{\phi mm}$ | 70,600 kg. |
| | for 6 pairs in six rows, the total sum of tensile strength comes to 70,600 kg × 6 = 423,600 kg. | |
| (2) | Weight of $65^{\phi mm}$ nylon eight rope: | |
| | In the atmospheric air | 522 kg/200 m |
| | In the sea-water | |

(Specific gravity of the sea-water)

$$522 \times \frac{1.14 - 1.03}{1.14} = 50{,}368 \text{ kg/200}$$

(Specific gravity of rope)

(3) Weight of ropes during the landing operation:
(Refer to FIG. 8)
Length of the rope in the range of the spots (a), (b) and (c) ..... $\underbrace{5{,}000 \text{ m} + 100 \text{ m}}_{\text{(In the sea-water)}} + \underbrace{20\text{m}}_{\text{(In the air)}} = 5{,}120 \text{ m}$ Weight of the rope in the above-mentioned condition:
5,100 m × 50,368/200 + 20 m × 522/200 =
1,284.39 + 52.2 = 1,336.59 kg.

(4) Number of buckets:
The distance between buckets is 20 m, thereby
5120 m/20 m = 256 p'cs.
which buckets are made an array of two rows, so that the number of buckets comes to 256 × 2 = 512 p'cs.

(5) Weight of buckets during the landing operation:
The weight per one bucket;

| | |
|---|---|
| In the atmospheric air | 37.8 kg |
| In the sea-water | 34.1 kg |

Weight of ores filled in one bucket;

| | |
|---|---|
| In the atmospheric air | 95.2 kg |
| In the sea-water | 86.5 kg |

(6) Weight of buckets during the landing operation by means of ropes:
In the atmospheric air 37.8 kg × 2 + 95.2 kg × 2 = 266 kg In the sea-water $$34.1 \text{ kg} \times 2 \times \underset{(256-1)}{255} + 86.5 \times 2 \times \underset{(256-1)}{255} = 61{,}506 \text{ kg}$$

-continued

Since the weight of landing ropes figured out in the item (3) comes to 1,336.59 kg, accordingly (Weight of bucket and ores in the air) (Weight of ropes in the air and in the sea)

266 kg + 61,506 kg + 1,336.59 kg (Weight of bucket and ores in the sea-water)

= 63,108.59 kg (7) (A) Weight of metal fixture for buckets:
The landing operation contains 256 sections and six metal fixtures are used per one section, thus
256 × 6 = 1,536 p'cs.
@1.15 kg × 1,536 = 1,766.4 kg (B) Weight of intermediate stoppers:
As each one of stoppers is set between a bucket and a diagonal bracing, two stoppers are used between each of adjacent buckets, accordingly;
256 × 2 = 512 p'cs
Further, the rope is made an array in 6 rows which are set in three rows, thereby
512 × 3 = 1,536 p'cs
@1.15 kg × 1,536 = 1,766.4 kg (8) Weight of pipes for fixing buckets:
As the weight of one pipe (32A × 800) is 2.74 kg., and four pipes are used for two buckets, thus
@2.74 × 256 × 4 = 2,805.76 kg (9) Weight of connecting metals and bracing metals for ropes:

(a) Weight of connecting metals for ropes:
In case of employing nylon eight rope having
$60^{\phi mm}$ × 2,000 m: 5,120m/2,000 m = 2.56 ≈ 3 p'cs
As the rope group are made an array in 3 rows, thus,
3 × 3 = 9 p'cs
@5 kg × 9 = 45 kg (b) Weight of bracing metals:
@5 kg × 256 = 1,280 kg

(10) Fluid resistance against buckets and ropes:

(a) Fluid resistance against buckets;
The fluid resistance against per one bucket
1 m × 0.7 m × 0.3 m = 8.7 kg (L) (B) (H)
The total number of buckets in the sea-water
2 × (256 − 1) = 510
Therefore, 8.7 kg × 510 = 4,437 kg (b) Fluid resistance against ropes;
Since the fluid resistance in the sea of 2,400 m deep against ropes of $40^{\phi mm}$ is figured out 150 kg., $$150\text{ kg}\,\frac{0.065\pi \times (5{,}000 + 100)}{0.040\pi \times 2{,}400} = 1{,}015.1\text{ kg}$$

So that, the fluid resistance against six ropes is figured out as follows;
1,015.1 × 6 = 6,090.6 kg

(11) Amount of ores landed per one hour:
As the landing velocity of buckets is 25m/min., the travelling distance of ropes per one hour comes
25m × 60 = 1,500 m
Therefore, as the distance between two buckets is 20 m., the number of buckets passing per one hour is
1,500m/20m = 75
and since the buckets are fixed to make an array in two rows, 75 × 2 = 150 p'cs.
Accordingly, with reference to the item (5),
95.2 kg × 150 = 14,280 kg, that is, 14.28 tons.
From the foregoing computation, the landing amount of ores is figured out to 14,280 kg per hour, however, when the capacity of the bucket is enlarged by 30% accompanying the increase of the landing amount to 20,000 kg per hour, the rate of safety reaches by 4.5 times in magnification and the security in operation can be assured.

(12) Total load exerted on the landing apparatus:

| | | |
|---|---|---|
| (3) | Weight of ropes during the landing operation | 1,336.59 kg |
| (6) | Weight of buckets and ores during landing | 63,108.59 kg |
| (7) | (A) Weight of metal fixture for the bucket | |

-continued

| | | |
|---|---|---|
| | | 1,766.4 kg |
| | (B) Weight of intermediate stoppers | 1,766.4 kg |
| (8) | Weight of pipes for fixing the bucket | 2,805.76 kg |
| (9) | (a) Weight of connecting metals for ropes | 45 kg |
| | (b) Weight of bracing metals | 1,280 kg |
| (10) | (a) Fluid resistance against buckets | 4,437 kg |
| | (b) Fluid resistance against ropes | 6,090.6 kg |
| | Total sum: | 82,636.34 kg |

(13) Coefficient of security:
Since the tensile strength of $65^{\phi mm}$ nylon eight rope is 423,600 kg as mentioned in the item (1),
The security coefficient $= \frac{423,600}{82,636} = 5.13$
With a security coefficient magnified five times, it can be recognized that safety in operation is assumed despite earth resistance and other abridged steps of process.

(14) Driving horsepower:
As the landing velocity of ropes is 25m/min. = 0.417 m/sec., it is figured out as follows:
82,636 kg $\times$ 0.417 = 3.4459 $\approx$ 350 KW.

It has been clearly elucidated in detail hereinbefore, that the dredging device according to the present invention is constructed with plural pairs of endless ropes composed of endless ropes made an array to be capable of translation motion. Pulleys for driving said endless ropes are provided composed of a plurality of component pulleys, each of which is coaxially pivoted at a preset distance. Buckets for scraping up ores are fixed and interposed between each pair of said endless ropes. When said endless ropes are brought into contact with and driven by a plurality of said pulleys, said bucket, which is located at the spot of the endless rope subjected to be in contact with and driven by the pulley, is adapted to travel through a plurality of said pulleys. Therefore, it is absolutely unnecessary in the present inventive device to adjust the position of fixing the bucket to the endless rope. Moreover, safe and reliable driving operation can constantly be attained even though swelling of ropes by the sea-water and slipping of ropes on the pulley may be taking place.

In addition, in the aforementioned embodiment, the rope is composed of a bundle of two endless ropes. However, twisting of the rope itself and intertwisting of ropes with one another which may often happen in the course of sending the rope down onto the seabed until the rope reaches the sea-bed can be prevented by such measures as composing the rope with a plurality of ropes containing more than two ropes in a bundle to be formed in a flat belt shape.

What is claimed is:

1. An apparatus for continuously dredging submarine mineral deposits comprising:

an endless rope for circulating over the upper deck of a barge and along the seabed;

buckets fixed to the endless rope to effect scraping-up the mineral deposit from the seabed;

pulleys to engage and drive the endless rope and to be mounted on the barge;

the endless rope including spaced parallel pairs of endless ropes each of which is capable of traveling in translational motion;

said pulleys including a plurality of component pulleys rotatably mounted coaxially at a preset distance;

each of said buckets being interposed between spaced pairs of endless ropes and affixed thereto and being adapted to travel between said component pulleys when each bucket is disposed at the location where the endless ropes are in contact with and driven by a plurality of said component pulleys;

clamping means including a metal pipe open at both ends for each endless rope, the endless rope mounted in both open ends of the metal pipe, adhesive within the pipe securing the rope therein, and caulking on the outer peripheral surface of the pipe to thereby fasten securely the pie to both ends of the rope and provide an endless rope;

a pair of spaced rods bridging adjacent spaced pairs of endless ropes and affixed thereto for each bucket and the bucket mounted to said rods thereby affixing the bucket to the spaced pairs of endless ropes while locating the buckets between the pairs of endless ropes so as to minimize adjustment of bucket position during use; and means for mounting each bucket to the rods to permit limited relative movement therebetween and lessen shock during use.

2. The invention in accordance with claim 1 wherein bracing is provided composed of overlapping diagonally extending pairs of rods fitted between each two spaced pairs of endless ropes and attached thereto so as to prevent said pairs of endless ropes from slipping with respect to each other.

* * * * *